US006840416B2

(12) United States Patent
Aberman

(10) Patent No.: US 6,840,416 B2
(45) Date of Patent: Jan. 11, 2005

(54) KNIFE SHEATH

(75) Inventor: Howard S. Aberman, Miami, FL (US)

(73) Assignee: Innovative Marine Products, LLC., Miami, FL (US)

( * ) Notice: Subject to any disclaimer, the term of this patent is extended or adjusted under 35 U.S.C. 154(b) by 153 days.

(21) Appl. No.: 10/189,877

(22) Filed: Jul. 3, 2002

(65) Prior Publication Data

US 2003/0006257 A1 Jan. 9, 2003

Related U.S. Application Data

(60) Provisional application No. 60/303,542, filed on Jul. 6, 2001.

(51) Int. Cl.[7] ..... B26B 29/02

(52) U.S. Cl. ..... 224/232; 224/674

(58) Field of Search ..... 224/232, 671, 224/672, 674, 677, 197, 901.4; 30/151, 162; D3/220

(56) References Cited

U.S. PATENT DOCUMENTS

| | | | | | |
|---|---|---|---|---|---|
| 84,612 | A | * | 12/1868 | Chillingworth | 224/232 |
| 831,770 | A | * | 9/1906 | Bragg | 224/232 |
| 1,123,862 | A | * | 1/1915 | Ellery | 224/232 |
| 2,387,900 | A | * | 10/1945 | Hartwell | 224/232 |
| 3,381,807 | A | * | 5/1968 | De Vaughn | 224/232 |
| 3,977,582 | A | * | 8/1976 | McMahon | 224/901.4 |
| 4,524,892 | A | * | 6/1985 | Ozeki | 224/232 |
| D289,913 | S | | 5/1987 | Ader | |
| D291,626 | S | | 9/1987 | Collins | |
| 4,942,663 | A | | 7/1990 | Ray, Sr. | |
| D352,823 | S | | 11/1994 | Chapman | |
| 5,419,472 | A | * | 5/1995 | Hellweg et al. | 224/193 |
| 5,568,888 | A | * | 10/1996 | Seber | 224/232 |
| D378,243 | S | | 3/1997 | Seber | |
| 5,915,607 | A | * | 6/1999 | Newboult, Jr. | 224/232 |
| 6,308,419 | B1 | * | 10/2001 | Neshat et al. | 30/151 |

* cited by examiner

*Primary Examiner*—Nathan J. Newhouse
(74) *Attorney, Agent, or Firm*—Christopher & Weisberg, P.A.

(57) ABSTRACT

A sheath for carrying a knife or blade is disclosed. The sheath includes a scabbard attached to a carrying strap forming a loop through which a carrying junction such as a belt may be passed. The axis of the loop is generally aligned with a transverse axis perpendicular to an axis of gravity. The length of the scabbard includes a longitudinal axis generally angled with respect to the axis of gravity. The mouth of the scabbard is further angled with regard to the transverse axis. Each of the foregoing alignments allows a user to more easily and efficiently insert and remove a blade into the scabbard while carrying the sheath. The sheath is also provided with an inner shell disposed inside the scabbard, the inner shell having a plurality of lengthwise linear ridges for gripping the blade inside the shell.

8 Claims, 4 Drawing Sheets

KNIFE SHEATH

REFERENCE TO RELATED APPLICATION

This application is related to and claims priority to U.S. Provisional Ser. No. 60/303,542, filed Jul. 6, 2001, entitled KNIFE SHEATH, the of which is incorporated herein by reference.

STATEMENT REGARDING FEDERALLY SPONSORED RESEARCH OR DEVELOPMENT n/a

FIELD OF THE INVENTION

The present invention relates to a knife sheath, and more particularly to a sheath for a curved or angled knife.

BACKGROUND OF THE INVENTION

Knives require sheaths for varying purposes. A proper sheath requires several attrubutes. Generally, an ideal sheath conforms to the contours of the knife, and incorporates the aesthetic design and quality of the knife. Furthermore, a sheath needs to properly enclose the blade to keep it safe from outside contact or for carrying and storage. Finally, a sheath must allow for easy and reliable insertion and retraction of the knife.

A problem arises in these criterion with regard to knives having various angles or curvature. Knives having blade portions disposed at an angle with respect to each other, or knives having curved blades are known as shown in FIGS. A-C. FIG. A shows a knife 100 having blade 105 with a longitudinal axis 107, and a handle 110 having a transverse axis 112 and longitudinal axis 115. This conventional "straight" knife 100 has corresponding longitudinal axes of the blade 107 and handle 115 in parallel alignment. The angle A formed by the blade longitudinal axis 107 and handle transverse axis is a right angle. Sheaths for such knives are fairly straightforward, having a generally orthogonal configuration that follows the contours of the knife blade along the axes shown.

This is in contrast with the angled or curved knives shown in FIGS. B and C. FIG. B shows a knife 120 having a blade 125, with longitudinal axis 127, and a handle 130 with transverse axis 132 and longitudinal axis 135. In this case, the angle B formed between the blade longitudinal axis 127 and handle's transverse axis 132 is not a right angle. FIG. C similarly shows a curved knife 140 having a blade 145, with a centroid 146 having a longitudinal axis 147 running therethrough, and a handle 150 with transverse axis 152 and longitudinal axis 155. In this case, the angle C formed between the blade's longitudinal axis 147 and the handle's transverse axis 152 is also not a right angle.

Placing knives such as knife 120 or knife 140 into known sheaths, such as rectangularly shaped sheaths more suited for knife 100, presents several problems. First, the blades do not fit properly. Second, the insertion and retraction of a blade into known sheaths is difficult, with the blade being easily stuck or grated against a surface. This is especially the case with plastic blade safety covers installed in such sheaths. Furthermore, as such knives are primarily intended for kitchen use, little attention has been paid to the needs of sportsmen who may wish to carry such a knife in an easily accessed manner. Many sporting knives are carried on a belt, such that the sheath must hang freely from a belt or other fastening point. The insertion or retraction of curved or angled blades into known straight sheaths creates added problems of friction, misalignment, and awkward movement.

Accordingly, it would be advantageous to provide a belt-mountable, rugged, easily-accessed sheath for a knife having an angled or curved blade and handle, allowing a user to easily insert and remove the blade into and out of the sheath.

SUMMARY OF THE INVENTION

The present invention provides a knife sheath, comprising a hollow body for receiving a knife blade, said body having proximal and distal end portions, a mouth disposed in said proximal end portion, and a first longitudinal axis spanning the proximal and distal end portions. The sheath further includes a suspension strap having first and second end portions secured to each other and to the proximal end portion of the body, to form a loop, and a second longitudinal axis, the second longitudinal axis intersecting with the first longitudinal axis to form a first smallest angle, the first smallest angle being less than ninety degrees.

Still another embodiment provides for a knife sheath comprising a sheath body having an angled mouth and a strap fixedly attached to the sheath body and forming a loop secured to the sheath body and having a longitudinal axis disposed at an angle with respect to a longitudinal axis of the sheath body, the hanging strap defining a loop extending beyond the angled mouth.

Yet another embodiment provides a blade carrying tool, comprising a casing having proximal and distal end portions, the proximal end portion defining a mouth for receiving the blade, the casing having a first axis of longitude, and a carrying member having proximal and distal end portions, the distal end portion being fixedly secured to the proximal end portion of the casing, the member having a second axis of longitude, wherein the first and second axis of longitude are not aligned.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1C:
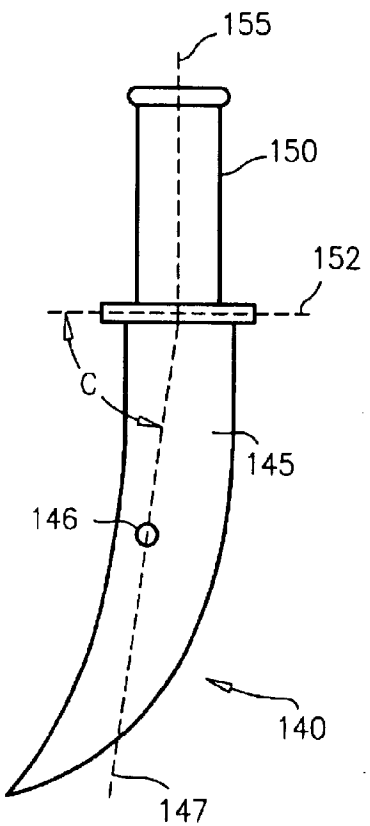
FIG. 1C is a view of a knife having a curved blade.
Figure 1B:
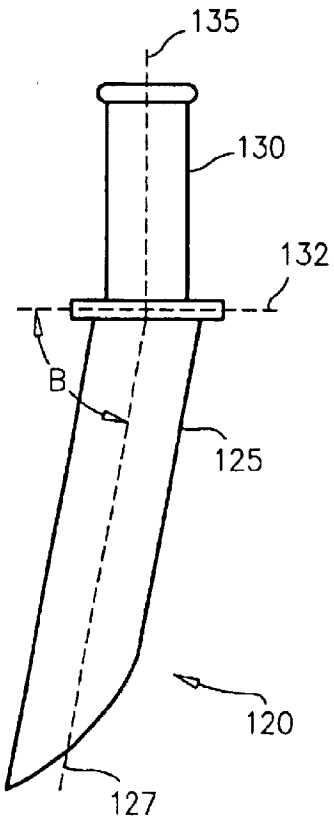
FIG. 1B is a view of a knife having an angled blade.
Figure 1A:
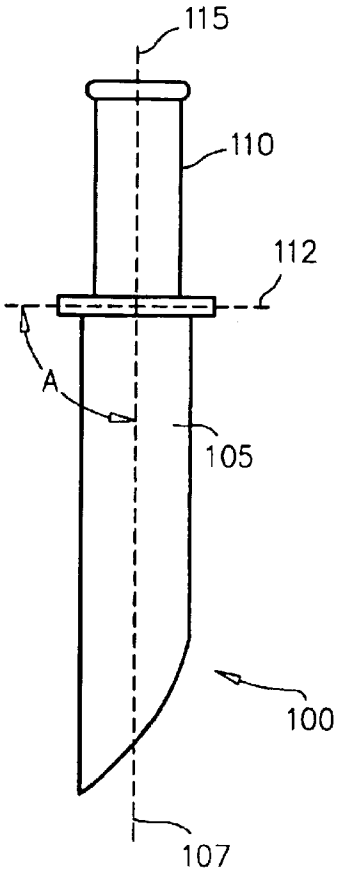
FIG. 1A is a view of a knife having a straight blade.
Figure 1D:
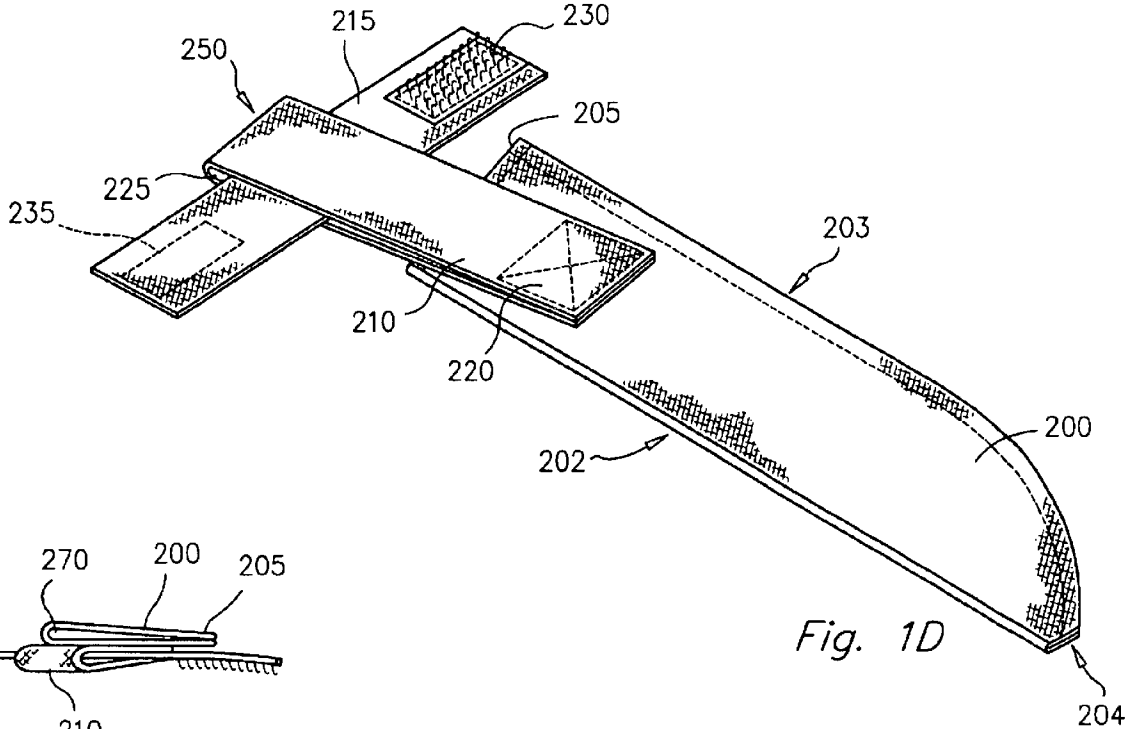
FIG. 1D is a perspective view of a knife sheath in accordance with the invention.

FIG. 1D illustrates a knife sheath or covering in accordance with the present invention. The sheath includes a sheath body or scabbard 200, having a front edge 202, back edge 203, tip 204, and top edge 205. The sheath also includes a suspension or carrying strap 210 and securing member 215. In the illustrated embodiment, the sheath body 200 is a scabbard or casing made of a robust material such as Cordura nylon which is shaped to provide a particular profile when folded and stitched as shown. The suspension strap 210, also made of Cordura nylon, includes a strip of material formed into a loop, stitched together at one end, and secured to the sheath body 200 at an attachment point 220. Cordura nylon is but one of many possible materials suitable for use with the present invention. It is appreciated that several other materials may also be used without deviating from the principles of the present invention, such as plastic or polymer, metal or metal alloy, natural or synthetic fibers or fabrics, or a composite material including metals, ceramics, fabrics, fibers, polymers, or any combination thereof.

As shown in FIG. 1D, the suspension strap 210 is angled with respect to the sheath body 200 with respect to the centerline axis of the sheath body 200. The knife handle securing mechanism or strap 215 is shown as a strip of Cordura nylon passed through an opening 225 defined by the upper end of the suspension strap 210. Although the securing strap 215 is shown as being freely slidable through the opening 225, it can alternatively be fixedly secured thereto. Hook and pile fasteners 230 and 235, respectively, are disposed on opposing sides of the securing strap 215 so as to be engagable when the securing strap 215 is formed into a loop.

Figure 2:
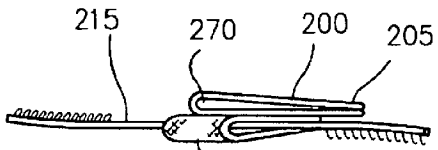
FIG. 2 is a view of a first end thereof.
Figure 3:
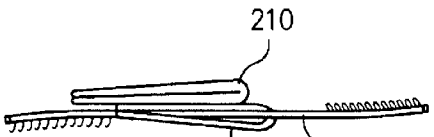
FIG. 3 is a view of a second end thereof.
Figure 5:
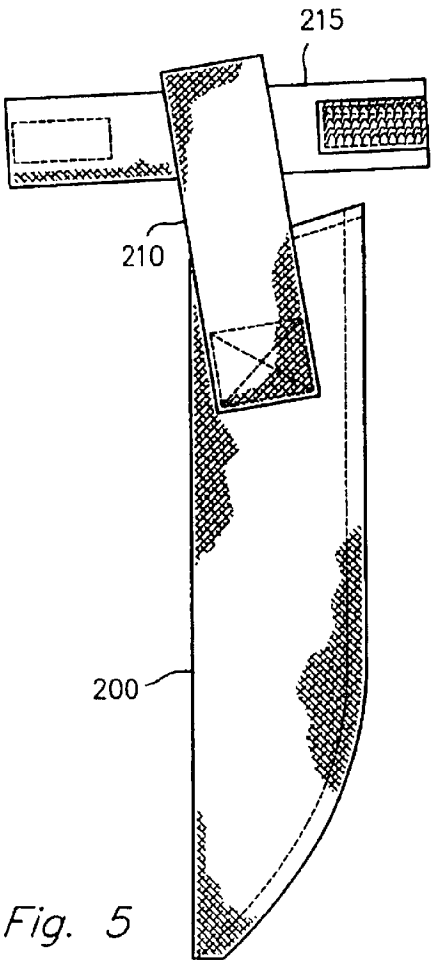
FIG. 5 is a bottom view thereof
Figure 4:
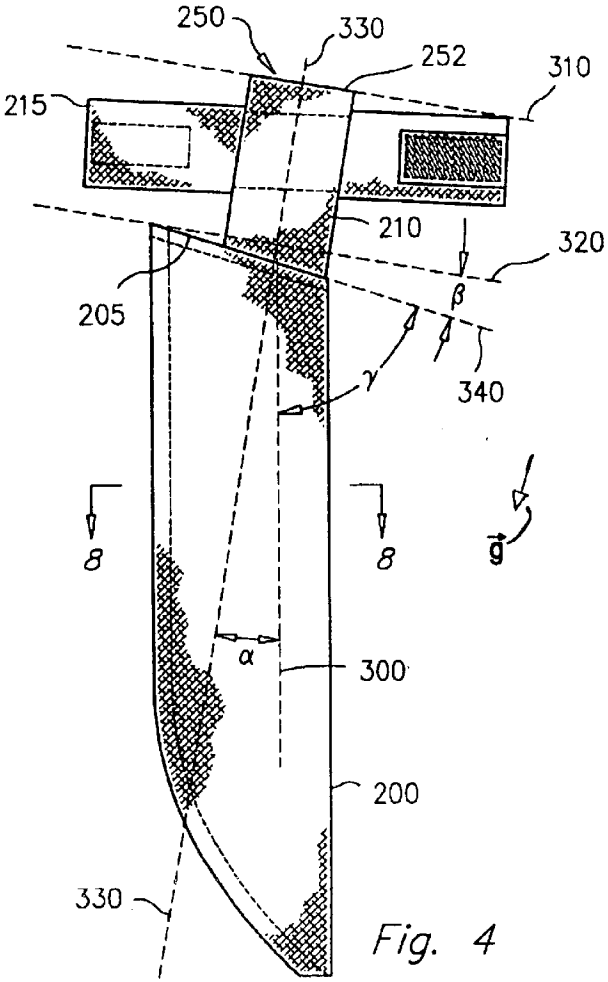
FIG. 4 is a top view thereof.
Figure 7:
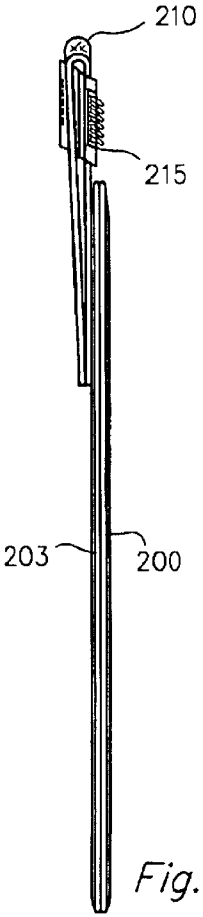
FIG. 7 is a view of a second side thereof.
Figure 6:
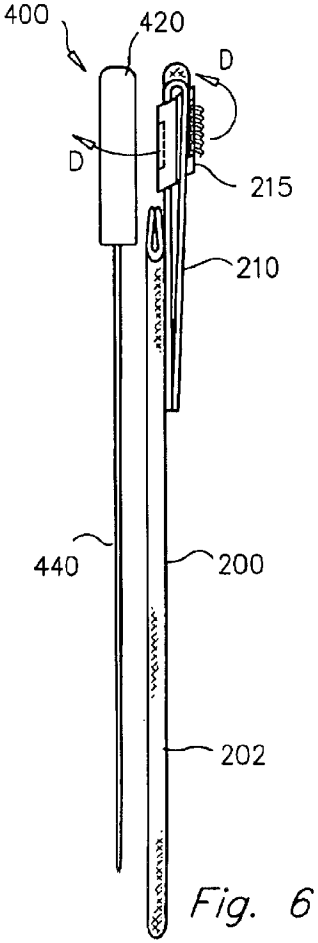
FIG. 6 is a view of a first side thereof.

FIGS. 2 through 7 illustrate additional views of the knife sheath, wherein FIG. 2 is a view from the sheath tip 204; and FIG. 3 is a view from the top edge 250 of the suspension strap 210. FIG. 4 is a plan view of the opposite side of the knife sheath presented in FIG. 1D, and FIG. 5 is a plan view of the knife sheath side as presented in FIG. 1D. FIG. 6 depicts the knife sheath from the front edge 202, and FIG. 7 shows the opposite back edge 203 of the knife sheath.

FIG. 2 shows the sheath from the top, illustrating the open mouth 270 of the sheath body 200. The mouth 270 may be any form of opening or channel defined by the top edge 205 of the sheath body 200 so as to allow for the entry of a blade. FIG. 3 shows the sheath from the bottom, wherein the tip 204 is sown or closed. It is understood however, that the particular configuration of the mouth 270 and tip 204 may vary widely depending on the particular shape of the knife and knife blade, and is by no means limited to the particular geometries displayed in the Figures.

FIG. 4 illustrates the advantageous configuration of the knife sheath shown in FIG. 1D. As shown in FIG. 4, body 200 has a longitudinal axis 300. The top edge 250 of the securing strap 215 has a transverse axis 310 tangent to the top edge 250 of the suspension strap 210. A second transverse axis 320, parallel to transverse axis 310 is also shown. Each of transverse axes 310 and 320 are orthogonal to the longitudinal axis 330 of the suspension strap 210. An additional tangential axis 340 is shown, it being tangent to the top edge 205 of the body 200.

An angle $\alpha$ is therefore formed between the longitudinal axis 300 of the body 200 and the longitudinal axis 330 of the suspension strap. Another angle $\beta$ is formed between the tangential axis 340 and the transverse axis 320. Although the embodiment depicted in FIGS. 1-7 bears the particular angles and configuration shown, the angles and relative orientation of the axes discussed herein may be varied without deviating from the principles of the invention. Angle $\alpha$ may vary from zero to forty-five degrees or more. Angle $\beta$ may vary from zero to forty-five degrees or more. One practical range for both angles $\alpha$ and $\beta$ is approximately two to twenty-five degrees for each. Another exemplary, yet more narrow, range for angle $\alpha$ would be approximately eight to fifteen degrees, while a narrower exemplary range for angle $\beta$ would be approximately ten to twenty degrees. The angle $\alpha$ shown in FIG. 4 is approximately 10 degrees, while the angle $\beta$ is approximately twelve degrees.

The sheath may be utilized such that a user inserts a belt (not shown) through the loop 225 formed by the suspension strap 210. The belt may be, for example, in alignment with transverse axes 310 and 320 and may fit therebetween. If the sheath were thus to hang from the belt, the longitudinal axis 330 of the suspension strap 210 would be in substantial alignment with a gravity vector $\vec{g}$. Thus the angle that the body 200 would make with gravity would be angle $\alpha$, while the angle that the top edge 205 of body 200 would make with the horizontal to gravity would be angle $\beta$. It is also apparent from FIG. 4 that the tangential axis is aligned with neither the transverse axis 320, or with a separate axis (not shown) transverse to the longitudinal axis 300 of the sheath body 200. This easily confirmed by inspection of an angle $\gamma$ between the axes 300 and 340, in that angle $\gamma$ is always less than a right angle.

It is precisely because angles $\alpha$ and $\beta$ are orientated with respect to a gravity vector $\vec{g}$ that the knife sheath has its advantageous qualities. First, because of angle $\alpha$ deviating from zero degrees, a user of the sheath may be able the easily insert a curved or angled knife into the sheath using a more natural motion rather than a straight up and down motion aligned with the gravity vector. Second, because of angle $\beta$ deviating from zero degrees, the handle portion of a curved or angled knife may be more easily buttressed against the top edge 205 of the sheath body 200.

FIG. 5 illustrates another plan view of the sheath shown in FIG. 4, including the body 200, suspension strap 210 and securing strip 215. This view of the present invention emphasizes that strap 210 may not be a loop at all, but may be a roughly "two-dimensional" carrying member, such as a simple rectangular strip as the securing strip 215. The securing strip 215 may for example be affixed to the upper or proximal end portion of the carrying member 210 at a right angle, while the lower or distal end portion of the carrying member 210 may be affixed to the upper or proximal end portion of the body 200 at an angle commensurate with the alignments discussed above with regard to and illustrated in FIG. 4. Or the securing member 215 may be omitted entirely, and the carrying member may be provided with a hole, hook, or some other mechanism for connecting to a junction or point for carrying the sheath, wherein the sheath may then freely hang such that the axis longitude 330 of the carrying member is not aligned with the axis of longitude 300 of the sheath body or scabbard 200.

FIG. 6 is a view of the sheath from the front edge 202. FIG. 6 also shows a knife 400 positioned alongside the sheath yet with the blade 440 outside the body 200 for ease of viewing. The knife 400 includes a handle portion 420, which is disposed substantially parallel to and against the suspension strap 210, such that ends of the securing strip 215 may be wrapped around the handle 420 in the direction of the arrows D as shown.

FIG. 7 shows the sheath from the back edge 203 of the body 200.

Figure 8:
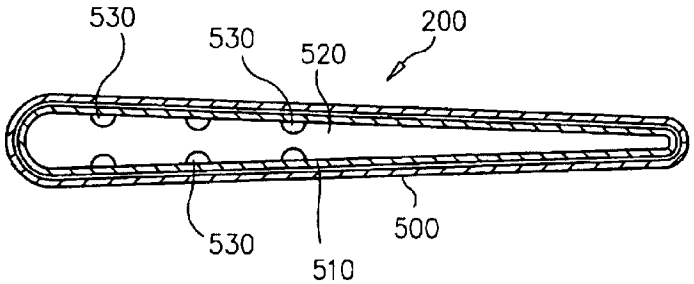
FIG. 8 is an enlarged sectional view of the sheath taken along section 8—8 in FIG. 4.

Finally, FIG. 8 is a transverse sectional view of the sheath body 200, taken along section 8-8 in FIG. 4. The body 200 includes an outer shell 500, and may further include an inner shell 510 enclosing the interior space 520 of the sheath body 200. A knife blade (not shown) inserted into the sheath body

200 will be thus disposed inside of the space 520. The outer shell 500 may be made of a robust material such as Cordura nylon, or some other fiber, fabric, composite, or other suitable material. The outer shell 500 may be rigid or flexible, yet substantially non-deformable. The inner shell 510 may in turn be more rigid, and may be made of a suitably rigid material such as a polymer such as polyvinylchloride (PVC).

The sheath may also include a series of ridges 530, which resemble linear "bumps" or strips that run the length of the body 200 parallel to longitudinal axis 300, and are positioned on the inner surface of inner shell 510 as shown in FIG. 8. The ridges are preferably made of a softer PVC-like material, and have a sufficient adhesive property to grip a smooth metal blade through static friction. The frictional grip imposed by the ridges 530 runs along the length of a blade, and hence provides an improved means of gripping the blade and keeping the knife inside of the sheath as desired.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A knife sheath, comprising:

a hollow body for receiving a knife blade, said body having proximal and distal end portions, a mouth disposed in said proximal end portion, and a first longitudinal axis spanning the proximal and distal end portions, wherein the hollow body further includes:

a substantially non-deformable outer shell, a rigid inner shell, the outer shell enclosing the inner shell, wherein the inner shell defines a space for receiving a knife blade, an inner length and an inner surface, the inner surface having a plurality of snaced apart elastically deformable linear ridges spanning the inner length of the inner shell, the linear ridges being substantially narallel to the first longitudinal axis and having a sufficient adhesive property to grip a blade through static friction, a suspension strap having first and second end portions secured to each other and to the proximal end portion of the body, to form a loop, and a second longitudinal axis, the second longitudinal axis intersecting with the first longitudinal axis to form a first smallest angle, the first smallest angle being less than ninety degrees.

2. The knife sheath of claim 1, wherein the first smallest angle is in the range of between one and forty-five degrees.

3. The knife sheath of claim 2, wherein the first smallest angle is in the range of between eight and fifteen degrees.

4. The knife sheath of claim 3, wherein the hollow body further includes:

a front edge and a back edge substantially parallel to said front edge, and an upper edge defining a proximal end of the body, the upper edge circumscribing the mouth of the body, wherein the suspension strap further includes a transverse axis orthogonal to the second longitudinal axis, and the upper edge defines a tangent line thereto, said tangent line forming a second smallest angle with said transverse axis, said second smallest angle being less than ninety degrees.

5. The knife sheath of claim 4, wherein the second smallest angle is in the range of between one and forty-five degrees.

6. The knife sheath of claim 5, wherein the second smallest angle is in the range of between ten and twenty degrees.

7. The knife sheath of claim 6, further including a securing strap member disposed substantially orthogonal to the suspension strap and through the loop formed by said suspension strap, the securing strap having:

first and second end portions and first and second sides, wherein a hook material is affixed to a portion of the first side and first end portion and a fastener material is affixed to a portion of the second side and second end portion.

8. The knife sheath of claim 7, wherein the securing strap is fixedly coupled to the suspension strap.

* * * * *